US007516755B2

(12) United States Patent
Parkkinen

(10) Patent No.: US 7,516,755 B2
(45) Date of Patent: Apr. 14, 2009

(54) SYSTEM FOR PRODUCING AND DISTRIBUTING COMPRESSED AIR

(75) Inventor: Raimo Parkkinen, Oulu (FI)

(73) Assignee: Op Systems Oy, Oulu (FI)

( * ) Notice: Subject to any disclaimer, the term of this patent is extended or adjusted under 35 U.S.C. 154(b) by 0 days.

(21) Appl. No.: 11/762,121

(22) Filed: Jun. 13, 2007

(65) Prior Publication Data

US 2007/0227596 A1 Oct. 4, 2007

Related U.S. Application Data

(63) Continuation of application No. 10/467,870, filed as application No. PCT/FI02/00126 on Feb. 15, 2002, now Pat. No. 7,240,692.

(30) Foreign Application Priority Data

Feb. 15, 2001 (FI) ..... 20010292

(51) Int. Cl.
*F04B 41/00* (2006.01)
*F17D 1/04* (2006.01)

(52) U.S. Cl. ..... 137/563; 137/565.18

(58) Field of Classification Search ..... 137/563, 137/565.18; 417/310, 313, 440, 442
See application file for complete search history.

(56) References Cited

U.S. PATENT DOCUMENTS

| | | | | |
|---|---|---|---|---|
| 48,886 | A | 7/1865 | Arthur | |
| 158,305 | A | 12/1874 | Picq | |
| 1,017,835 | A | 2/1912 | Wilkinson | |
| 1,865,110 | A | 6/1932 | Johnson et al. | |
| 4,653,532 | A | 3/1987 | Powers | |
| 5,433,587 | A | 7/1995 | Bankert et al. | |
| 5,558,141 | A | 9/1996 | Dannohl | |
| 5,582,030 | A | 12/1996 | Dannohl | |
| 5,775,442 | A | 7/1998 | Speed | |
| 5,890,549 | A | 4/1999 | Sprehe | |
| 7,240,692 | B2 * | 7/2007 | Parkkinen | 137/563 |

FOREIGN PATENT DOCUMENTS

| | | |
|---|---|---|
| DE | 2410832 | 9/1975 |
| JP | 62-98783 | 6/1987 |
| JP | 10-246201 | 9/1998 |

* cited by examiner

*Primary Examiner*—John Rivell
(74) *Attorney, Agent, or Firm*—Young & Thompson

(57) ABSTRACT

The invention relates to a system for producing and distributing compressed air that comprises at least one compressor (1) having connected thereto a suction pipe (2) for the intake of air and an output pipe (3) for air compressed by said at least one compressor, and distribution piping (4) connected to the output pipe (3) for distributing air to sites of use (5, 6). According to the invention, the system further comprises a return pipe (7) arranged between the suction pipe (2) and at least one site of use (5) for receiving air reduced in pressure in it and feeding it back to said at least one compressor (1).

13 Claims, 1 Drawing Sheet

SYSTEM FOR PRODUCING AND DISTRIBUTING COMPRESSED AIR

FIELD OF THE INVENTION

The present invention relates to a system for producing and distributing compressed air that comprises at least one compressor having connected thereto a suction pipe for the intake of air and an output pipe for air compressed by said at least one compressor, and distribution piping connected to the output pipe for distributing air to sites of use.

The invention also relates to a system for producing and distributing compressed air that comprises at least one compressor having connected thereto means for suction air intake and an output channel for air compressed by said at least one compressor, and distribution piping connected to the output channel for distributing air to sites of use.

The invention thus concerns industrial and instrument air systems, in which the conventional pressure level is 10 to 15 bar or less, in which the pressurized dew point of the compressed air is generally appropriate for the intended purpose, i.e. even −40° C., and in which the length of the manifold and distribution piping can be several kilometers.

In a conventional compressed air system, described above, the compressed, after-treated air discharges into the environment after use. Correspondingly, the compressors generally obtain untreated air for compression from the environment through a suction pipe. Since suction air contains dirt particles, it usually needs to be filtered for the first time already in a suction filter before it enters the compressor and is used. Filtering causes a certain negative pressure in the suction pipe depending on the filtering fineness and the degree of filter contamination, which in turn increases the energy requirement of the compressor to some extent. In addition, the suction filter requires servicing and maintenance, which causes additional costs to the production of compressed air. Suction air often also contains caustic gas components that enter the compressor with suction air and may cause corrosion in the air compression space of the compressor, when heating up during compression and when the concentration increases.

An especially bad situation in this respect exists in unlubricated, i.e. dry, screw and piston compressors, in which oil does not protect them from corrosion. To eliminate this common problem, the inner parts of these compressors are made of corrosion-proof materials. For instance, the screw units of an unlubricated screw compressor are coated with Kevlar or some other coating or they are made of corrosion-proof materials. Thus, the price of these compressors is high due to the high manufacturing costs of the screw elements, for instance.

In lubricated screw and rotary compressors, too, foreign gas components can end up with the circulated cooling and sealing oil, weakening its properties and consequently, causing deterioration in lubrication. This is why the oil needs to be changed relatively often. The oil is relatively expensive, because in this task, it is required to have many special properties. Due to the above matters, producing compressed air causes considerable fixed and variable costs, when done by a screw compressor, for instance.

Suction air always contains moisture, because air always contains water vapour. Water needs to be removed from compressed air before use. A requirement can be that the maximum pressurized dew point is −20° C., for instance, which means that water does not condensate in the piping when the compressed air remains at a temperature above said level and the piping does not freeze. For this purpose, compressed air systems are equipped with dewatering systems and different types of dryers to achieve the desired pressurized dew point.

For the same purpose, a considerable number of other components are needed, such as different types of water reducers, an after-cooler for lowering the temperature of the compressed air and different types of filters, the number of which depends on the compressor type, for instance. The amount of removed water can be very large, such as 100 liters per 24 hours.

Oil-lubricated compressors, for instance, typically always have an external (located after the compressor package) coarse and fine oil-separating filter prior to the actual adsorption dryer. In addition, some of these compressors have internal separating filters for separating drop and aerosol oil integrated to the compressor package. After the often-used adsorption dryer, there is also a dust separation filter and sometimes even an active carbon filter and bacterial filter. Oil-lubricated screw compressors also have an oil trap for the purpose of separating the oil, which has ended up in the compressed air from the oil cooling of the compressor, and condensed water from each other. The water condensate is usually run into the sewer, even though it still at this stage has some oil residue. Oil traps do not remove any water pollutants possibly carried along with the suction air.

Everything described above is called after-treatment of compressed air, in which solid particles, oil and water is removed from the compressed air. The corresponding equipment is called a compressed air after-treatment system. The most comprehensive after-treatment system is found in the very commonly used oil-sealed screw compressor systems, in which the essentially most important component of the after-treatment system is the dryer, but a number of filters and other equipment are also needed for oil removal. The extent of separating these in each case during after-treatment depends on the required compressed air quality class according to the ISO 8573 standard.

The after-treatment of compressed air forms approximately 25% of the price of compressed air. This includes fixed costs, too, but mainly the costs are variable costs, of which the share of energy is significant. The filters, for instance, typically cause a total pressure loss of 1,500 kPa depending on their degree of contamination, which means a nearly 10% increase to the energy required to produce compressed air, because the compressors must operate with a delivery pressure that is higher to the extent of this pressure loss. The after-treatment equipment requires a great deal of servicing and maintenance, which also increases the variable costs.

In lubricated compressors, especially in oil-sealed screw and rotary compressors, the temperature of the compressed air cannot be lowered below a certain level, because then the moist air coming from the suction pipe with the compressed air would condense into water in the compressor and the oil used for cooling and sealing would be whisked together with the water into an emulsion as the rotors turn. As a paste-like substance, this emulsion would cause blockage in the filters, and the oil trap would not work as desired, because oil and water form a mixture that the present equipment cannot separate. In time, if nothing is done, this leads to a stoppage in the production of compressed air, which may cause a shutdown in the production of the industrial plant.

For this reason, in these compressors, the temperature of the suction air and the output air from the compressor must be kept generally at least at +60° C. depending on the temperature of suction air. This, in turn, results in the need to control the cooling of the compressed air, in other words, the temperature and/or volume flow of the cold cooling oil sprayed into the space between the rotors, so that the temperature of the air to be compressed would not drop too low. This also means that the compression process in the compressor is isentropic with an isentropic exponent of nearly 1.3. The compression is far from an ideal compression process requiring the least amount of energy and taking place at a constant temperature, i.e. an isothermal compression process. This means that the specific energy consumption of the compressor is high. The isothermal efficiency of these compressors is probably in the range of 70%, so approximately 30% more energy is consumed in the compressor than in ideal compression at constant temperature.

BRIEF DESCRIPTION OF THE INVENTION

It is an object of the present invention to provide a compressed air system, in which the above-mentioned problems are at least mainly eliminated. This is achieved by a system for producing and distributing compressed air according to the invention, which is characterized in that the system further comprises a return pipe arranged between a suction pipe and at least one site of use for receiving air reduced in pressure in it and feeding it back to said at least one compressor. One version of the invention is characterized in that the system comprises return means for receiving air reduced in pressure in the usage site and feeding it back to said at least one compressor.

The basic idea of the invention is thus that at least some of the air used in the system remains in the system and consequently, need not be dried after various compression times. This results in immediate cost savings. The larger the amount of system air that can be kept within the system, the bigger the savings are.

In the compressed air system of the invention, the dried compressed air used in the distribution system is returned to the compressor as (compressor) suction air. This air to be compressed is dried and of high quality, and the removal of the compression heat of oil-sealed and oil-cooled screw and rotary compressors can easily be improved to such an extent that compression is done nearly isothermally in the compressor, because the moisture of the suction air cannot now cause problems with the compressor oil separation. This way, a saving of up to 20% is achieved in the energy consumption required to produce compressed air. Other advantages include a significant improvement in oil separation in the screw and rotary compressors that have an internal oil separation system, because oil sprayed at a lower compression temperature remains in drop or aerosol format and can thus be more easily removed from the compressed air already inside the compressor. In the present compressors, in which the compression is isentropic and, therefore, the compressed air is hot, oil enters as vapour into the piping and it is not possible to remove it completely and even reducing the amount requires specific filtering systems.

Because the compressed air system of the invention can be completely closed and if there are no leaks in it, it is also possible to use other gases than outdoor air, such as dry nitrogen gas, as the medium. All compressor types can compress nitrogen gas. If there are leaks in the system, they can be easily detected and measured. Leaks can be compensated for in many ways, for instance by a separate small compressor producing dry air, or if there are other sources of dry air, by taking the replacement air from them. Dry air circulation is even then maintained in the system.

Because moisture does not enter the system with the suction air, as in conventional open compressed air systems, a sound leak-free system requires no after-treatment equipment.

In oil-sealed screw compressors, the oil trap also becomes unnecessary. As a result of this, the compressor can be operated using a lower pressure, because there is no pressure loss in the after-treatment equipment, which can in a conventional industrial air system be as high as 1,500 kPa. This means that the compressor output decreases approximately 10%, because the specific energy decreases strongly when the delivery pressure of the compressor decreases. In addition, the energy-consuming recovery of the adsorption dryers or, in the case of a cooling dryer, the electric energy required to run the cooling compressor, is left out.

The return pipe, which can be connected to the suction air connection of the compressor, also does not apparently require a suction air filter to remove mechanical particles and caustic gases do not enter the system together with the suction air, so the inner parts of the compressor are not corroded. The compressors can then be inexpensive compressors with non-corrosion-protected compression and displacement spaces. Noise transmitted from the suction pipe to the environment is also reduced.

The suction air of a compressed air compressor is usually taken from a space having as good quality air as possible: a minimum degree of dust, no caustic gases, no combustion engine exhaust gases, etc. The suction pipe is at best located on a south or east facing side, where the temperature during summer is as low as possible. These factors limit the selection of the location of the compressor or compressor centre. No such limitations exist in the compressed air system of the invention, and the compressors can be located freely, for instance outdoors. There is no danger of malfunction even during frost, if air-operated heat exchangers are used. The pressurized dew point of the air to be compressed is then expected to be sufficiently low, in other words, the air should be so dry that water is not condensed from the compressed air and freeze even during very low below-zero temperatures.

In conventional compressed air systems, the following compressed air treatment apparatuses are needed in the given order for instance when the pressurized dew point requirement is −40° C., as in pneumatic instrumentation systems, and an oil-sealed screw compressor is used: an actual compressor unit that contains, integrated into the same package, a suction air filter, an actual pressure-generating screw unit and a two-phase oil-separating cyclone and filter combination; a compressed air tank; an oil-separating filter; a fine oil-separating filter; an adsorption dryer; a dust filter; and sometimes also an active carbon filter and a bacterial filter. In addition, an oil trap is also needed. The compressed air system of the present invention does not require the suction air filter, compressed air tank or the other pressure-side filters, if used in the special case where the compressor is an oil-sealed screw compressor and the suction air is treated in such a manner that its pressurized dew point is sufficiently low and does not contain mechanical impurities. The adsorption dryer and the oil trap are then also unnecessary. Thus, all after-treatment devices are unnecessary. In addition, the compression process of the compressor can be made nearly isothermal by improving to a sufficient extent the oil cooling directed to the air being compressed between the screw elements. This is possible, because there is no moisture in the suction air. The internal oil separation of the compressor package is then improved so that practically all oil is separated, because no oil vapour is generated due to the low compression temperature. If for the purpose of saving energy, a higher than atmospheric pressure is to be used in the suction pipe, the pressure endurance of the suction side can easily be changed in a standard compressor and in a situation where the circulating compressor is a booster compressor, i.e. a pressure boost compressor.

If the system of the invention is leak-free, it is also possible to economically use other gases than air in it. One such gas is nitrogen. In a closed system like the one described herein, means for drying the gas are not needed. Only when the system is taken in to use, it is necessary to use either dried air or separate means for drying the air fed into the system.

In usage sites, from which the compressed air is led into return piping, the system of the invention also makes possible a procedure, in which after the usage site, the air pressure is not the normal atmospheric pressure, but even significantly higher than that. This type of compressed air drive connected to a return cycle can thus be arranged to first have a 10-bar pressure and afterwards a 3-bar pressure, in which case the pressure difference over the drive is 7 bars. Depending on the compressor properties, approximately 40% less energy is required to raise the air pressure from 3 bars to 10 bars than when raising the compressed air pressure from 0 bars to 7 bars. Thus, the use of a pressure level higher than the normal atmospheric pressure after the unit, and consequently in the suction pipe of the compressor, also reduces significantly the operating costs of the system. This is possible, because the force of a double-acting cylinder, for instance, is the same in both cases.

If the system cannot be made completely closed due to compressed air drives, such as blow, spray-painting or pneumatic pipelining drives, in which air cannot be recovered, means for replacing the removed air are required in the system. Such a means can be a second suction pipe connected to said at least one compressor for feeding in replacement air, which replacement air can be either untreated moist outdoor air or air that is dried and substantially moisture-free. If moist air is used, the system needs a dryer, through which this moist replacement air is run to achieve the desired dew point. In this case, too, only a part of the air in the system needs to be replaced and dried, and thus, the drying capacity of the system can be significantly lower than in conventional compressed air systems. Replacement air intake can also be arranged to be periodical, i.e. to occur only when the pressure in the return pipe decreases too much. Drying then also needs to be done only periodically, which leads to significant savings in the operating costs.

In another alternative, especially if the need for replacement air is great, the air required by the blow drives is fed with the original compressors having dryers. Their own closed system having a circulation compressor can then be used for drives, in which exhaust air can be recovered. Because this second system is in the distribution piping in an area, in which air is already dry, a dryer is not needed in this system. The filling of the system and a possible compensation for leaks in this system can easily be done using the distribution piping of the previous system.

BRIEF DESCRIPTION OF THE FIGURES

In the following, the system for producing and distributing compressed air according to the invention will be described in greater detail with reference to the attached drawing, in which.

DETAILED DESCRIPTION OF THE INVENTION

Figure 1:
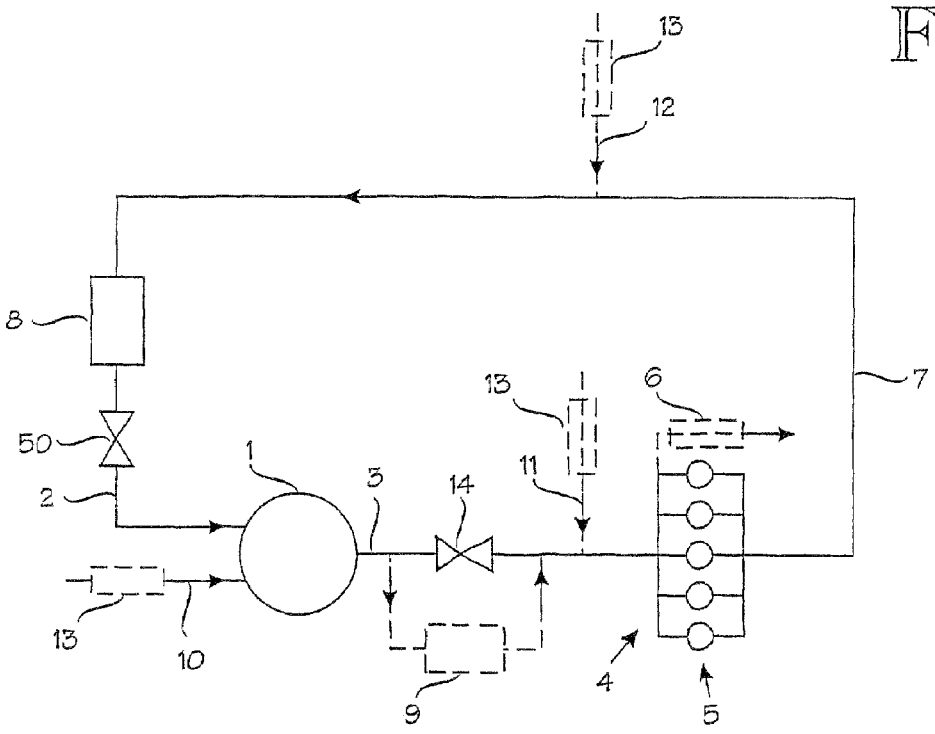
FIG. 1 is a very simplified diagram of a first exemplary embodiment of the system of the invention.

FIG. 1 shows by way of example a very simplified diagram of a first embodiment of the system of the invention. This diagram includes only the components of a compressed air system that are essential for the invention. Thus for the sake of clarity, conventional and, in part, necessary devices of compressed air systems, such as after-treatment devices for the air produced in the compressor, for example an after-cooler, compressed air tank, dryer, oil separators or separating devices of other solid particles, are not shown.

The system shown in general in FIG. 1 comprises a compressor 1 with a suction pipe 2 and output pipe 3 connected to it. The output pipe 3 is connected to compressed air distribution piping 4 leading to devices 5, from which output air can be recovered. From the devices 5, a return pipe 7 leads to an air tank 8 that is, in turn, connected to the suction pipe 2 of the compressor 1. The tank 8 is, however, not necessarily needed in the system, especially if the volume of the return pipe is sufficient per se. If the system does not contain a drive, such as a blow drive or the like, in which air cannot be recovered, as shown by a dashed line and marked with the reference numeral 6, the system can be made fully closed. All compressed air led to sites of use 5 is then recovered to the return pipe 7 and can be returned to the compressor 1. This type of system can also be easily implemented in the currently used compressed air drives. It is, for instance, possible to guide the air discharged from the control valves of regulating units, through which the air that is reduced in pressure discharges, to the return pipe of a circulating compressor. In FIG. 1, equipment 9 represents the after-treatment equipment of compressed air with any possible dryers, through which compressed air can, if necessary, be driven in connection with after-treatment; it can also be by-passed, if necessary. The return pipe 7, i.e. the means for receiving air reduced in pressure in one or more sites of use 5 and for feeding it back to at least one compressor, thus returns compressed air to the input side of the compressor, i.e. directly or indirectly to the suction pipe. The suction pipe is the means for bringing suction air to the compressor. In FIG. 1, the return air in the return pipe 7 comes through the tank 8 to the suction pipe, and correspondingly, it is possible to use for instance an implementation, in which the return of the return air in the return pipe is through an intermediate pressure tank between the first and second compressor phase to the suction side of the second compressor phase, if the compressor is a two-phase compressor.

The invention can also be examined in a system for producing and distributing compressed air that comprises at least one compressor 1 or 21 with means 2 or 22 for the intake of suction air connected to it and an output channel 3 or 23 for air compressed by said at least one compressor, and distribution piping 4 or 26 connected to the output channel 3 or 23 for distributing air to the sites of use 5, 6 or 25. The system further comprises return means 7 or 27 for receiving air reduced in pressure in the site of use and feeding it back to said at least one compressor 1 or 21. The means 2 or 22 for the intake of suction air comprise a suction pipe 2 or 22 and the return means comprise a return pipe 7 or 27.

If the system is completely closed and does not need air from the outside, no external moisture enters the system and it does not need a dryer providing sufficiently dry air is used when the system is filled. Dry-air filling can be done by a separate filling system including a suitable dryer or by using pressurized air that has been sufficiently dried to contain no moisture when produced. Even though the system of FIG. 1 in its most conventional form contains air as pressurized gas, its closed structure also permits the use of some other gas, such as nitrogen, if this is otherwise advantageous especially due to the structure of the drives, such as the regulating units.

Because the system of FIG. 1 does not in principle have a dryer and there is no need for one, a significant amount, such as a quarter, of compressed air production costs can be saved in comparison with a conventional system that does not have circulation and in which all air used in the system always needs to be dried.

The system of FIG. 1 also makes it possible to raise the pressure levels of the drives, if the structures of the drives are suited for the higher pressure. For instance, it is possible to use the system in such a manner that the pressure in the distribution piping after the compressor is 14 bar, for instance, and the pressure in the return pipe after the drive is 7 bar. The power needed by the compressor of the system is then only approximately 30% of the power that would be needed if the system was used in such a manner that the pressure after the compressor was 7 bars and the pressure in the return pipe was 0 bar, i.e. atmospheric pressure. The above numerical values are only an example of what raising the general pressure level of the system can achieve in cost saving. It is more probable that the pressure levels must be kept lower than described above especially due to the fact that conventional compressed air drives are not suited for use at the pressures described above. In any case, the generation of a normal operating pressure difference in such a manner that a predefined counter pressure also prevails after the drive leads to a significant cost saving.

A dashed line in FIG. 1 shows a compressed air drive 6 that is thought to be a blow drive, i.e. a drive in which compressed air cannot be recovered. Therefore, air escapes from the system through it. To replace the escaped air, the compressor 1 is equipped with a second inlet 10 shown by a dashed line. If normal air, i.e. air containing moisture, is taken in through this inlet, an after-treatment equipment 9 including dryers, which is shown by a dashed line, must be included into the system to remove the moisture in this replacement air. A valve 14 also shown by a dashed line then closes the direct pipe connection 3. If pre-dried air is fed to the inlet 10, the dryer is naturally not needed or it can be by-passed. In any case, the after-treatment equipment 9 can be significantly smaller in capacity and moisture removal ability, because it only needs to dry the air required by the blow drive 6. The after-treatment equipment 9 can also be used in such a manner that air is run through it only when drives, which let air escape from the system, are in operation. The after-treatment equipment thus need not be kept in continuous use, which also saves energy. In such a case, there is no pressure loss, because air is run past the after-treatment equipment 9.

The blow drive 6 can alternatively be thought to represent leaks that exist in most compressed air systems. If the system is otherwise fully closed, leaks in the system can be very easily and reliably detected and their size measured in the system of FIG. 1. Namely, if pipe leaks exist, this results in an immediate decrease in pressure on the suction side of the compressor 1, if the compressor delivery pressure is kept constant. This pressure decrease can be easily measured and the amount of air escaped from the system thus determined, when the combined volume of the suction pipe 7 and the tank 8 is known. The easy measuring of a possible leakage amount or leakage flow is another a significant advantage of the closed system of the invention over a conventional open compressed air system.

Possible leaks can be compensated either in the manner described above, in which the compressor is equipped with a second inlet 10, or by supplying after-treated and dry air into the distribution piping. Dashed lines 11 and 12 in FIG. 1 show this supply. The inlet 11 connects to the distribution piping before sites of use 5 and the inlet 12, in turn, connects to the return piping 7. All above-mentioned replacement air supply routes 10, 11 and 12 are also connected to a unit 13, which is a gauge that measures the air volume flow and/or amount of air flown through the unit and thus provides direct information on the leakage flow of the system or its amount or the volume flow or amount of air that the leaks and drives, in which air cannot be recovered, consume together. The unit 13 can also contain a check valve, pressure-reducing valve or pressure-regulating valve, by means of which the connection to an external air source can be opened or closed as desired or replacement air can be automatically let in to the system, if necessary. To compensate for leaks, the system should be equipped with one of the alternatives shown by dashed lines in FIG. 1. When using the inlet 10, the inlet 2 is closed with a valve 50, for instance.

The above describes, how leaks can be measured in a closed system. The same principle can also be used to measure the compressed air amount or volume flow consumed together by the blow drives and possible leaks. If the volume flow required by the blow drives is known—this being easily determined by commercial volume flow sensors—piping leak flow can be obtained from the total volume flow by subtracting the volume flow required by the blow drives. Correspondingly, if it is known that there are no piping leaks, the method can be used to determine the compressed air volume flow or amount used by the drives, in which air cannot be recovered.

Figure 2:
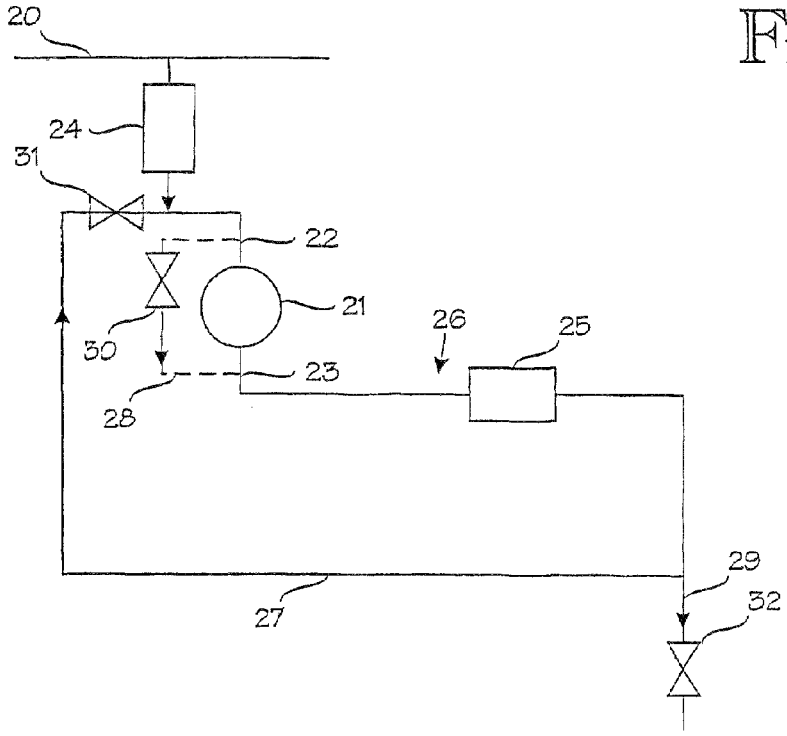
FIG. 2 is a very simplified diagram of a second exemplary embodiment of the system of the invention.

FIG. 2 shows by way of example a very general diagram of a second embodiment of the system of the invention. In it, the sites of use of the system are marked with the reference numerals 25. In these sites, all air can be recovered. In this system of FIG. 2, a system that essentially corresponds to that of FIG. 1 is build around the drives 25 enabling air recovery. The system comprises at least one compressor 21 that has a suction pipe 22 and output pipe 23 feeding compressed air through distribution piping 26 to the drives 25, and a return pipe 27 that connects the drives to the suction pipe 22 of the compressor 21. The suction pipe 22 is connected to the compressed air distribution piping 20 of an industrial plant, for instance, by means of equipment 24 that contains at least a valve, which is possibly a pressure-reducing valve or pressure-regulating valve, through which additional air is released into the suction pipe 22 when necessary.

The compressed air distribution piping 20 belongs to a compressed air production system that, when necessary, provides sufficiently high-pressure, such as 8-bar, after-treated compressed air having a sufficiently low dew point. By means of the equipment 24, this compressed air can be released into the suction pipe 22 of the compressor 21 either for filling the system or for compensating for possible leaks. The equipment 24 can thus contain a check valve, pressure-reducing valve or pressure-regulating valve, by means of which the pressure level of the suction pipe 22 can be set to 2 bars, for instance. The equipment 24 can also contain a flow meter, by means of which the need for replacement air, i.e. the amount of leaks in the closed circuit containing the compressor 21, is directly revealed. If the pressure of the suction pipe 22 is 2 bars, as mentioned above, and the delivery pressure of the compressor 21 is 9 bars, a pressure of over 7 bars affects over the sites of use 25.

Because the air in the piping 20 is already dry, no separate dryer is required in this closed branch connected through the equipment 24, and air coming from the compressor 21 can be directly fed to the drives 25 enabling air recovery. Returning the dry air reduced in pressure through the return piping 27 to the suction pipe 22 leads to not needing to re-dry the air circulated through the drives 25. The system of FIG. 2 thus achieves the same savings by means of air recovery from the drives 25 as described earlier in connection with the system of FIG. 1.

The system of FIG. 2 also has components, connected to it by dashed lines, that relate to a situation, in which the compressor 21 does not for some reason produce compressed air. Safety arrangements are necessary, if the continuous operation of the drives 25 is to be secured. This has to do with a so-called primary network implementation for important sites of use 25. The availability of compressed air for the sites of use 25 is then secured even in a situation, in which the compressor 21 cannot produce compressed air. The option of a primary network solution is another advantage of the closed system of the invention over the conventional open compressed air system. If the compressor 21 is damaged, the pressure of the network 20 is let directly into the output pipe 23 of the compressor by-passing the compressor 21 by means of a by-pass line 28 and a valve 30 in it and by controlling the equipment 24 in such a manner that a direct connection is opened to the industrial air network 20. Because the circulation compressor is not operating, air that is reduced in pressure is let out after the drives 25 through an output 29 by opening its valve 32. In addition, the output of the equipment 24 needs to be disconnected from the return line 27 by closing a valve 31 in it so as to prevent the pressure of the network 20 from discharging through the output 29. The system is then open, because air from the drives is not recovered for circulation, but directed outside using the pipeline 29 and valve 32. The pressure of the compressed air network 20 then acts on the compressed air drive 25, so no interruption in use occurs.

The system of FIG. 2 is also interesting in that it offers a very advantageous way to increase the capacity of the compressed air system either when a new site of use is added to the system, in which the compressed air reduced in pressure can be recovered, or if the system already comprises such sites of use, from which recovery can be arranged in a simple manner. If the capacity of a conventional open compressed air system is nearly entirely in use, very large investments are possibly required to increase the production and after-treatment capacity of the compressors. Such an expensive investment can be avoided by using the solution of FIG. 2, because the capacity of the basic system 20 then need not be increased, if the drives 25 are separated from the system into their own closed cycles or new drives 25 are added to it, since these drives 25, which are in a closed cycle, do not at all increase the amount of air needed by the basic system 20. This way, an expensive capacity increase of the basic system can be replaced by an inexpensive additional compressor 21 that does not even need any after-treatment equipment.

If we examine generally a compressed air system of the invention that requires after-treated compressed air (maximum dew point requirement is for instance +2° C., −20° C. or −40° C.) and the compressed air production system comprises oil-lubricated screw or rotary compressors, the after-treatment equipment is in practice not needed and thus does not cause any pressure loss, so the energy saving is approximately 15%. In addition, it is possible to use nearly isothermal compression, which means an energy saving of 25%. If there is a 2-bar pressure in the suction pipe (=return pipe) and the delivery pressure of the compressor is 9 bars to produce a 7-bar pressure for the site of use, an energy saving of over 15% is achieved. If all above-mentioned savings can be included in the same system, the total saving is over 50%. With other compressor types, the energy saving is approximately 25%, because their compression process cannot be improved in the same manner as that of oil-lubricated screw and rotary compressors. In this case, too, the after-treatment system is unnecessary.

If no requirements are set on the dew point and the compressors are oil-lubricated screw or rotary compressors, the same result as above is achieved. In this case, too, dried suction air should be used so as to achieve a nearly isothermal compression process in the compressor. The energy saving is the same as above. When using other compressor types, dried air does not need to be used in circulation, and moist air is also suitable. Removing condensed water from such replacement air can be done in an elementary manner, for instance by means of conventionally built water reducers, if desired and necessary. Energy saving is then approximately 25%.

It should also be noted that circulation can be done in any compressed air system on some level by using either an existing compressor or by taking into use a new compressor (or compressors) dedicated to circulation. The possibilities and the extent to which the invention can be applied are determined according to the structure and type of the system.

The system of the invention for producing and distributing compressed air is described above using only some exemplary embodiments and it is to be understood that these systems can be modified without departing from the scope of protection defined in the attached claims.

The invention claimed is:

1. A system for producing and distributing compressed air, comprising:

at least one compressor having connected thereto a suction pipe for the intake of air and an output pipe for air compressed by said at least one compressor;

distribution piping connected to the output pipe for distributing air to sites of use;

a return pipe arranged between the suction pipe and at least one site of use for receiving air reduced in pressure in said site of use and feeding it back to said at least one compressor;

a source of compressed air; and equipment provided between the distribution piping and the source of compressed air for controlling intake of compressed air from the source of compressed air into the distribution piping for replacing air exited from a circuit formed by the compressor with its suction and output pipes, distribution piping, sites of use and the return pipe, the compressed air from the source being fed to the high-pressure side of the compressor.

2. The system as claimed in claim 1, wherein the pressurized dew point of the compressed air in the source of compressed air is defined in advance.

3. The system as claimed in claim 1, wherein the delivery pressure of said at least one compressor is 15 bars or less.

4. The system as claimed in claim 1, wherein said equipment comprises means for setting the pressure prevailing in the distribution piping.

5. The system as claimed in claim 4, wherein the system further comprises means for opening a connection from the return pipe to atmosphere and means for separating the return pipe from the suction pipe.

6. The system as claimed in claim 5, wherein the system further comprises means for bypassing said at least one compressor.

7. The system as claimed in claim 1, wherein said equipment comprises a flow meter for measuring the amount of air taken from the source of compressed air.

8. The system as claimed in claim 1, wherein the system further comprises means for measuring the pressure prevailing in the distribution piping.

9. The system as claimed in claim 1, wherein said at least one compressor is an oil-lubricated screw or rotary compressor.

10. The system as claimed in claim 2, wherein the dew point is one of +2° C., −20° C., and −40° C.

11. The system as claimed in claim 1, wherein the pressure of the compressed air in the source of compressed air is higher than the output pressure of the compressor.

12. A system for producing and distributing compressed air, comprising:

a compressor having connected thereto a suction pipe for the intake of air and an output pipe for air compressed by said at least one compressor;

distribution piping connected to the output pipe for distributing air to sites of use and recycling air used by the sites to the suction pipe of the compressor, the piping defining a closed loop system with the air used by the sites not being exhausted and rather returned to the suction pipe of the compressor;

a return pipe arranged between the suction pipe and the sites of use for receiving the air used at the sites and feeding the used air back to said compressor;

a source of compensating compressed air configured only for compensating for air losses within the closed loop system; and equipment provided between the distribution piping and the source of compressed air for controlling intake of compressed air from the source of compressed air into the distribution piping for replacing air exited from the closed loop system, the compensating compressed air being fed to the high-pressure side of the compressor.

13. A system for producing and distributing compressed air according to claim 12, wherein a total capacity of the closed loop system is increased only by adding new closed circuits to the system.

* * * * *